United States Patent [19]

Stubbs et al.

[11] 3,955,165

[45] May 4, 1976

[54] METHOD OF MAGNETISING THE FLYWEIGHTS OF A GOVERNOR

[75] Inventors: John Stubbs, Liverpool; James Douglas, Chester, both of England

[73] Assignee: Joseph Lucas (Industries) Limited, Birmingham, England

[22] Filed: July 19, 1974

[21] Appl. No.: 490,059

[52] U.S. Cl. ..... 335/284; 73/518; 73/540

[51] Int. Cl.[2] ..... H01F 13/00

[58] Field of Search ..... 335/284; 317/151, 123; 310/74, 153; 73/518, 540

[56] References Cited

UNITED STATES PATENTS

| | | | |
|---|---|---|---|
| 2,715,528 | 8/1955 | Schulte | 73/540 X |
| 2,890,877 | 6/1959 | Straznickas | 73/540 X |
| 3,070,731 | 12/1962 | Janicke | 335/284 |
| 3,303,398 | 2/1967 | Barta et al. | 335/284 X |
| 3,370,600 | 2/1968 | Peterson | 73/518 X |
| 3,398,328 | 8/1968 | Piekarski | 317/151 X |

*Primary Examiner*—George Harris
*Attorney, Agent, or Firm*—Holman & Stern

[57] ABSTRACT

The flyweights of a governor of the general kind having magnetised flyweights and a field coil for modifying the bias of the flyweights, are magnetised by applying a voltage pulse to the coil when the governor is stationary.

2 Claims, 3 Drawing Figures

METHOD OF MAGNETISING THE FLYWEIGHTS OF A GOVERNOR

This invention relates to centrifugal governors of the kind comprising a rotatably mounted flyweight carrier, a flyweight pivotably mounted on the carrier, means for rotating the carrier to revolve the flyweight in an orbit, said flyweight having a portion on one side of said pivotal mounting effective centrifugally to pivot the flyweight in response to rotation of the carrier, means for creating a magnetic field having a portion passing through said orbit to bias the flyweight toward movement relative to the carrier, electrical means for varying the intensity of the magnetic field and thereby varying the effective mass of said portion of the flyweight.

The invention resides in a method of magnetising or remagnetising said portion of the flyweight comprising the step of applying a voltage to said electrical means when said flyweight is stationary.

An example of the invention is illustrated in the accompanying drawings, in which.

Figure 1:
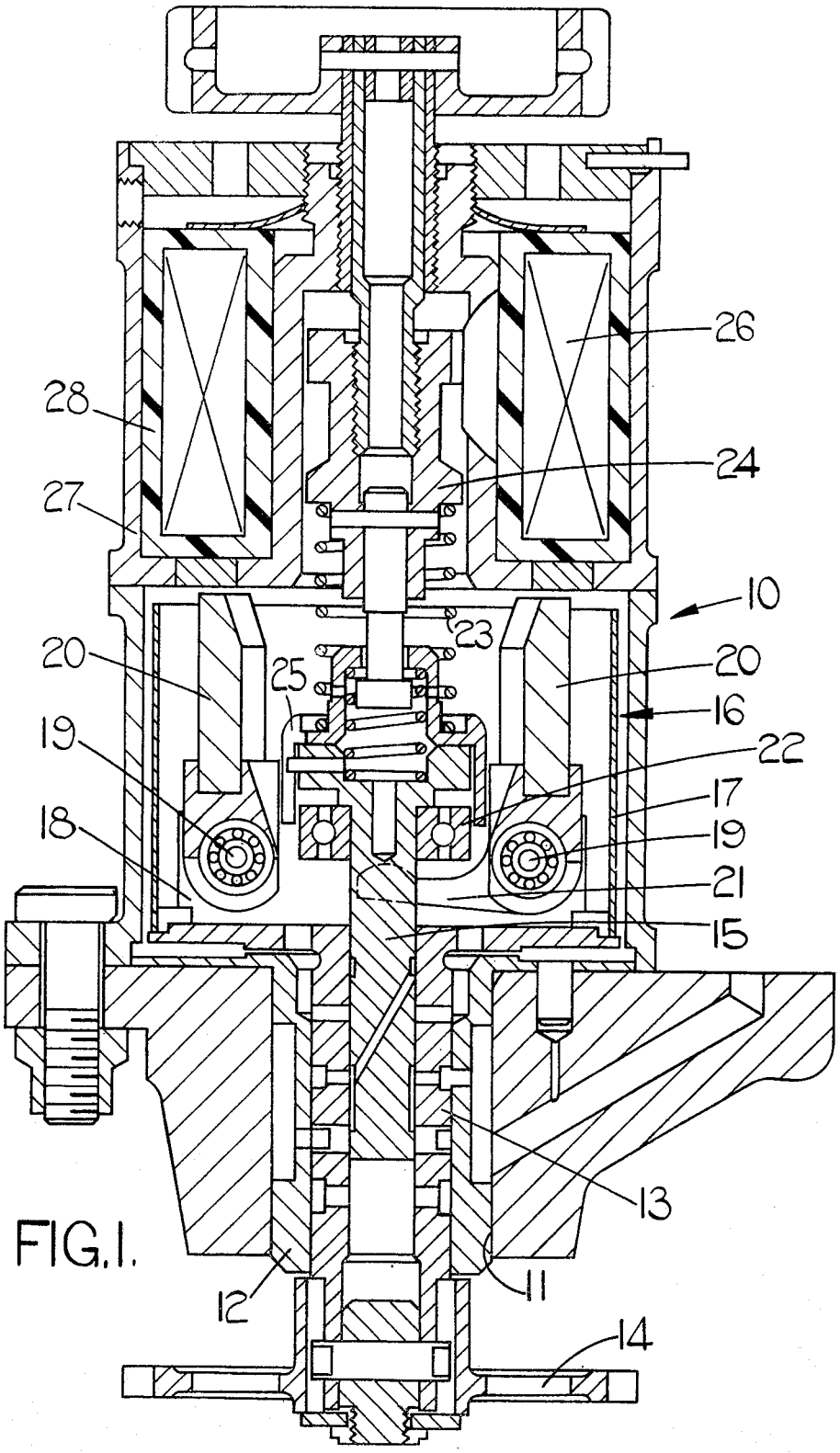
FIG. 1 is a vertical section through the governor.

Referring to FIG. 1, there is shown therein a centrifugal-type governor including a casing 10 having a cylindrical bore 11 in which is fixed a ported sleeve 12. The sleeve 12 forms a support for a drive sleeve 13 which extends through the sleeve 12 and is rotatable therein. The drive sleeve 13 is secured to a spur gear 14 which can be rotated in accordance with the speed of rotation of the device to be governed.

A pilot valve 15 extends into the sleeve 13 and is movable axially under the influence of a centrifugal governor 16 to control the fluid pressure supplied at an outlet (not shown) of the governor.

The centrifugal governor 16 includes a cup-shaped member 17 fixed to the upper end of the drive sleeve 13. A cage 18 is formed integrally with the drive sleeve 13 and supports pivot pins 19, upon which flyweights 20 are mounted. The cup-shaped member 17 is merely a cylindrical cover which is used to keep the pivot pins 19 from falling out and to restrain the flyweights 20 from pivoting outwardly far enough to contact the interior of the casing 10. The flyweights 20 are generally L-shaped and each is provided with an inwardly extending leg portion 21 positioned under a bearing 22 whose inner race is secured to the upper end of the pilot valve stem 15. By this arrangement, outward pivotal movement of the upper ends of the flyweights serves to move the inwardly extending legs 21 upwardly, and hence move the pilot valve upwardly to effect control. The centrifugal action of the flyweights is opposed by the bias of a spring 23 which seats at its upper end on an adjustment assembly 24 threadedly received in the casing 10 and rotatable to adjust the tension of the spring. The opposite end of the spring 23 seats in a cup-shaped member 25 supported by the inner race of the bearing 22, and thus transmits the spring force to the stem of the pilot valve 15.

Thus, changes in rotational speed of the gear 14 will cause a corresponding pivoting action of the flyweights 20, outwardly if the speed increases, and inwardly if the speed decreases. Such pivotable movement of the flyweight is transmitted into movement of the pilot valve 15, resulting in the change of fluid pressure at the aforesaid outlet of the governor. In the device so far described, changes in the control effected by the flyweights are possible only by adjusting the pre-compression of the spring 23 through the medium of the adjusting assembly 24. However, electrical means are provided for producing changes in the governing effect of the flyweights, so that a further control of flyweight position can be superimposed on the rather broad control thereof afforded by the counteraction between the spring 23 and the centrifugal force exerted by the flyweight. To this end, magnetic forces are used which can be arranged to operate either with or against the effect of centrifugal force, and the magnetic forces may be less or greater than the centrifugal forces exerted upon he flyweights, as desired. Because of the fact that magnetic means are used to effect this additional control, it will be clear that an immediate response of the flyweights thereto can be obtained, and thus a control can be produced which is capable of functioning with rapidity.

The flyweights 20 are thus magnetised so as to have a pole at their upper free end. Immediately above the free ends of the magnetised flyweights 20, there is located an annular electromagnet 26. The core of the electromagnet has, of course, a multitude of wire turns wound concentric with the axis of rotation of the flyweights, and by passing a direct electrical current through the magnet coil a magnetic field is produced. When a current is passing through the coil, the same will act in a nature of a magnet, having one pole at the one end of the coil indicated by the reference numeral 27, and the opposite pole at the other end of the coil indicated at 28. An external magnetic field will extend between the poles of the electromagnet, and thus will extend across the orbit of rotation of the upper poles of the magnet.

It will be appreciated that the strength and direction of the direct current fed into the electromagnet 26 will produce varying control effects on the permanent magnetised flyweights 20, and will either accentuate the centrifugal force to which such flyweights are subjected or counteract such centrifugal force, depending upon the direction in which the current passes through the electromagnet. The intensity of the current will, of course, vary the intensity of the effect.

The result of the foregoing is that the effective mass of the flyweights is varied, or more broadly, the mass moment of the flyweights can be attenuated or augmented by the electrical means provided.

One disadvantage of such a governor is that the flyweights 20 gradually become de-energised and it is necessary to remagnetise them every so often.

Present methods of magnetising involve the removal of the complete governor assembly from the constant speed drive to which it is fitted. It is then inserted into an external coil for magnetisation. The arrangement shown makes use of the electromagnet existing within the governor for magnetisation, which makes it unnecessary to remove the governor from the constant speed drive, which on an aircraft in service can mean a considerable financial saving in both time and labour.

Thus, by applying a voltage controlled pulse of energy to the electromagnet 26, when the flyweights are stationary, the flyweights 20, which are formed of highly permeable material, will be magnetised or demagnetised depending on the polarity of the pulse.

Figure 3:
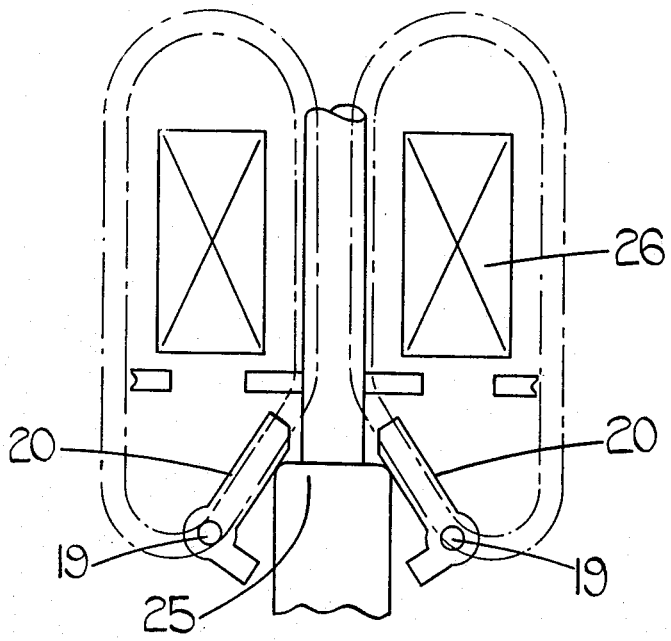
FIG. 3 is a diagrammatic illustration of some of the parts in FIG. 1.

When the flyweights are stationary the magnetic circuits of the electromagnet and flyweight magnets are in-line and the air gap is at a minimum allowing maximum flux to flow in the magnetic circuit and thus maximum magnetisation to take place as shown in FIG. 3. When the flyweights are rotating they pivot outwards under centrifugal influence thus increasing the air gap in the magnetic circuit and the optimum conditions for magnetisation as described above are not present. The use of a voltage controlled pulse prevents the electromagnet from overheating which could happen if it were continuously energised at the voltage level required to effect magnetisation.

Figure 2:
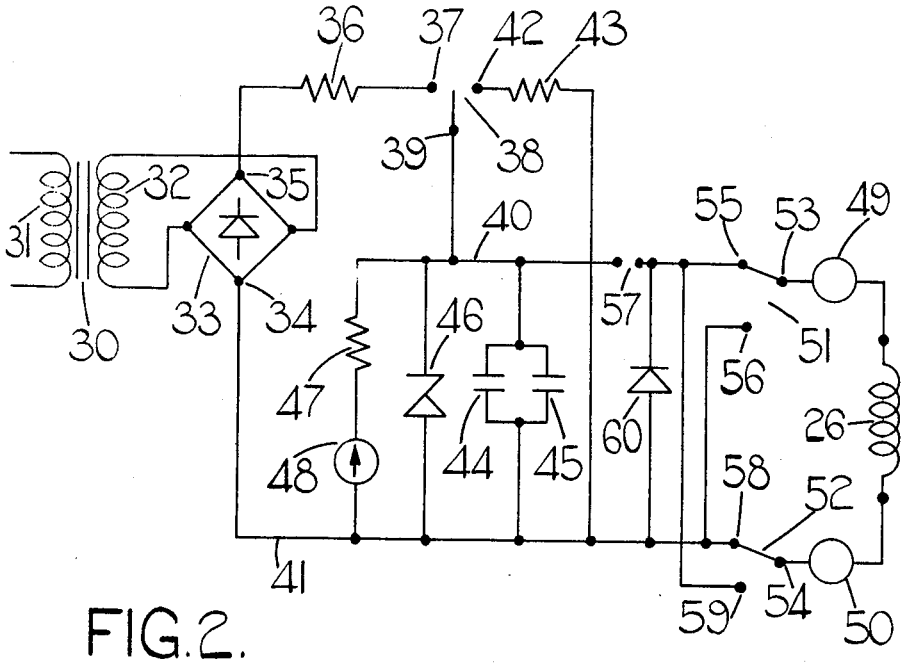
FIG. 2 is a circuit diagram illustrating an arrangement for performing a method in accordance with an example of the invention.

FIG. 2 illustrates an electrical circuit by which a voltage pulse can be applied to the electromagnet 26 to effect such magnetisation of the flyweight 20. This circuit comprises of a transformer 30 having a primary winding 31. This transformer can be one of two types:

A. Mains operated with winding 31 connected to a fused 240 volt 50 Hz supply.

or

B. D.C. operated with transformer 30 forming part of a d.c. to a.c. inverter allowing the unit to be portable and run from internal batteries.

The transformer has a secondary winding 32, the output of which is rectified by a rectifier bridge 33. The rectifier bridge 33 has two output terminals 34 and 35 the latter of which is connected through a resistor 36 to one terminal 37 of a single pole two way switch 38. The movable contact of the switch 38 is connected to a terminal 39 which is connected to a line 40. The terminal 34 of the rectifier bridge 33 is connected to a supply line 41 which is connected to the remaining terminal 42 of the switch 38 via a resistor 43. A pair of capacitors 44 and 45 are connected electrically in parallel between the lines 40 and 41, and these capacitors are bridged by a series circuit comprising a resistor 47 and an ammeter 48 which can be used to give an indication of the voltage across the capacitors 44 and 45. The circuit has a pair of output terminals 49 and 50 between which the winding of the electromagnet 26 is in use connected. There is also provided two further single pole two way switches 51 and 52 the movable contacts of which are connected to terminals 53 and 54 respectively which are in turn connected to the output terminals 49 and 50 respectively of the circuit. The switch 51 has two further terminals 55 and 56, the terminal 55 being connected through a push button switch 57 to the line 40, and the terminal 56 being connected to the line 41. The switch 52 also has two further terminals 58 and 59, the terminal 58 being connected to the line 41 and the terminal 59 being connected to the normally open push button switch 57 to the line 40. A commutating diode 60 is connected between terminals 41 and the junction of 55 and 59.

In operation, the movable contact of the switch 38 is moved into contact with the terminal 37 to allow the capacitors 44 and 45 to charge to a desired voltage indicated by the ammeter 48 and as soon as this voltage is reached the switch 38 is opened. By closing the push button switch 37, the capacitors 44 and 45 are discharged through the winding of the electromagnet 26 in one direction or the other dependent upon the positions of the switches 51 and 52. If the capacitors 44 and 45 are over charged then the charge on these can be reduced by moving the switch 38 so that the movable contact engages the terminal 42 thereby allowing the capacitors to discharge through the resistor 43.

The tendency for the capacitors 44 and 45, and the electromagnet coil 26 to form an oscillating circuit, could generate reverse polarity currents to flow in the coil which would adversely effect the magnetising process. Also premature release of the push button switch 57 could cause a back e.m.f. to be generated in the electromagnet coil 26 which would damage the insulation of the coil. The commutating diode 60 eliminates these effects by absorbing any reverse energy flow generated by the electromagnet coil 26.

The advantage of pulse magnetisation is that a charge of energy of known maximum value is stored in the capacitors 44 and 45. This energy is then discharged into the magnetising coil 26 in the form of a voltage pulse. The value of the capacitors has been selected to give the pulse a time duration, sufficient to effect maximum magnetisation whilst at the same time reducing the heating effect on the coil to a minimum. The disadvantage of continuously energised sources is that the amount of energy fed to the coil is uncontrolled and can cause overheating and damage to the coil.

I claim:

1. A method of magnetising or demagnetizing a magnetic flyweight of a centrifugal governor which includes a rotatably mounted flyweight carrier, a magnetic flyweight pivotally mounted on the carrier, means for rotating the carrier to revolve the flyweight in an orbit, said flyweight having a portion on one side of said pivotal mounting effective centrifugally to pivot the flyweight in response to rotation of the carrier, means for creating a magnetic field having a portion passing through said orbit to bias the flyweight toward movement relative to the carrier, and electrical means for varying the intensity of the magnetic field and thereby vary the effective mass of said portion of the flyweight while being pivoted, said method comprising the step of applying a voltage pulse to said electrical means when said flyweight is stationary within said governor to thereby create a magnetic circuit of maximum flux trough said magnetic field creating means and said magnetic flyweight, said voltage pulse if of a first polarity causing said stationary magnetic flyweight to be rapidly magnetized and if of a second polarity causing said stationary magnetic flyweight to be rapidly demagnetized.

2. A method as claimed in claim 1 in which the voltage pulse is applied by charging a capacitor to a predetermined voltage and subsequently discharging said capacitor through a resistor and a coil in series, said coil forming part of said electrical means.

* * * * *